United States Patent [19]

Clifton et al.

[11] Patent Number: 4,640,351

[45] Date of Patent: Feb. 3, 1987

[54] SEALING PACKER

[75] Inventors: Ted G. Clifton, Tulsa; Robert L. Brookey, Jerks, both of Okla.

[73] Assignee: Arrow Oil Tools, Inc., Tulsa, Okla.

[21] Appl. No.: 783,207

[22] Filed: Oct. 2, 1985

[51] Int. Cl.[4] ..... E21B 33/124

[52] U.S. Cl. ..... 166/127; 166/147; 166/186

[58] Field of Search ..... 166/120, 127, 141, 147, 166/186, 191

[56] References Cited

U.S. PATENT DOCUMENTS

| | | | |
|---|---|---|---|
| 2,760,580 | 8/1956 | Johnston | 166/120 |
| 3,645,335 | 2/1972 | Current | 166/120 |
| 4,279,306 | 7/1981 | Weitz | 166/147 |
| 4,289,200 | 9/1981 | Fisher, Jr. | 166/120 |
| 4,519,456 | 5/1985 | Cochran | 166/147 |

*Primary Examiner*—James A. Leppink
*Assistant Examiner*—Terry Lee Melius
*Attorney, Agent, or Firm*—Edgar A. Zarins; Steven L. Permut; Malcolm L. Sutherland

[57] ABSTRACT

A packer for a down hole oil well includes an inner mandrel assembly having an upper outer sleeve assembly that includes the hold down mechanism and upper packer seals with a piston on the underside of the packing seals to be pressure responsive and to deform the seals in response to pressure within the well string. Furthermore, a lower outer sleeve assembly has packing elements that are deformed and a setting mechanism to allow the packer to be set in a position within the well casing. Upper and lower unloading valves allow for fluid the bypass the packers when the packer is retrieved upward through the well casing.

5 Claims, 12 Drawing Figures

SEALING PACKER

TECHNICAL FIELD

This invention relates to a sealing packer that can be used for selectively acidizing sections of well casing.

BACKGROUND OF THE INVENTION

A sealing packer can be used to seal off portions of well casing when certain other sections are acidized. Commonly, a sealing packer can seal the upper portion of a well casing when the entire lower zone is acidized. Furthermore, sealing packers have been manufactured to allow acidizing of particular footage of well casing while sealing off the well casing both above and below the acidized section., Haliburton PPI packers have upper and lower packer elements which are spaced apart to allow acidizing to take place therebetween. Upper and lower exposed slips retain the packer in place against unwanted downward movement or against upward pressures within the well casing.

However, the packer element must often have increased sealing capabilities during increased well pressures. It is therefore desirable to have a booster piston which can further compress the packer elements during high pressures that are present within the well tubing.

Furthermore, it is desirable to have the packer that has an unloading gate valve that can be selectively opened or closed below the lower packer element to allow easy retrieval of the packer. It is also desirable to have enclosed slips for easy transportation and protection thereof.

SUMMARY OF THE INVENTION

In accordance with one aspect of the invention, a sealing packer for a well includes a tubular inner sleeve with an axial extending passage therethrough. An upper outer sleeve assembly is mounted about the inner sleeve and has a seat for seating a resiliently deformable upper packing element. A hold down device for engaging a well casing and retaining the outer sleeve assembly stationary against upwardly directed well pressures is also mounted to the upper outer sleeve assembly. A lower outer sleeve assembly is slidably mounted about the inner sleeve and includes a lower packing element seated between a movable seat and a fixed second seat that is selectively fixed to the well casing. The lower outer sleeve assembly has an abutment that presses the upper packing element against the seat in the upper outer sleeve assembly. A piston is interposed between the abutment and the upper packing element and is responsive to pressure in the well casing between the lower and upper packing elements. The piston is separable from the abutment to further deform the upper packing element in response to higher well pressures. The tubular inner sleeve has a port from the central passage for allowing fluid communication from the passage to the well casing at a position between the upper and lower packing elements.

Preferably, a lower unloading valve includes apertures passing through the inner sleeve and the lower outer sleeve assembly. The apertures are selectively aligned to selectively open the unloading valve when the inner sleeve is upwardly moved with respect to the outer sleeve assemblies and close the valve by downward movement of the inner sleeve. The apertures, when aligned, are in fluid communication with the central passage and a top unloading valve through the upper outer sleeve assembly to let fluid flow through the inner sleeve bypassing the packing elements as the sealing packer is retrieved upwardly.

A broader aspect of the invention relates to the tubular body having a central passage with setting means for setting the tubular body in position in a well casing. At least one deformable packing element is mounted about the tubular body with a mechanism for deforming the packing element and becoming sealed against the well casing. A piston is adjacent the packing and is responsive to pressure in the central passage to press against the packing element and further deform the packing element to create a stronger seal against the well casing.

BRIEF DESCRIPTION OF THE DRAWINGS

Reference now will be made to the accompanying drawings in which.

DETAIL DESCRIPTION OF A PREFERRED EMBODIMENT

Figure 1A:
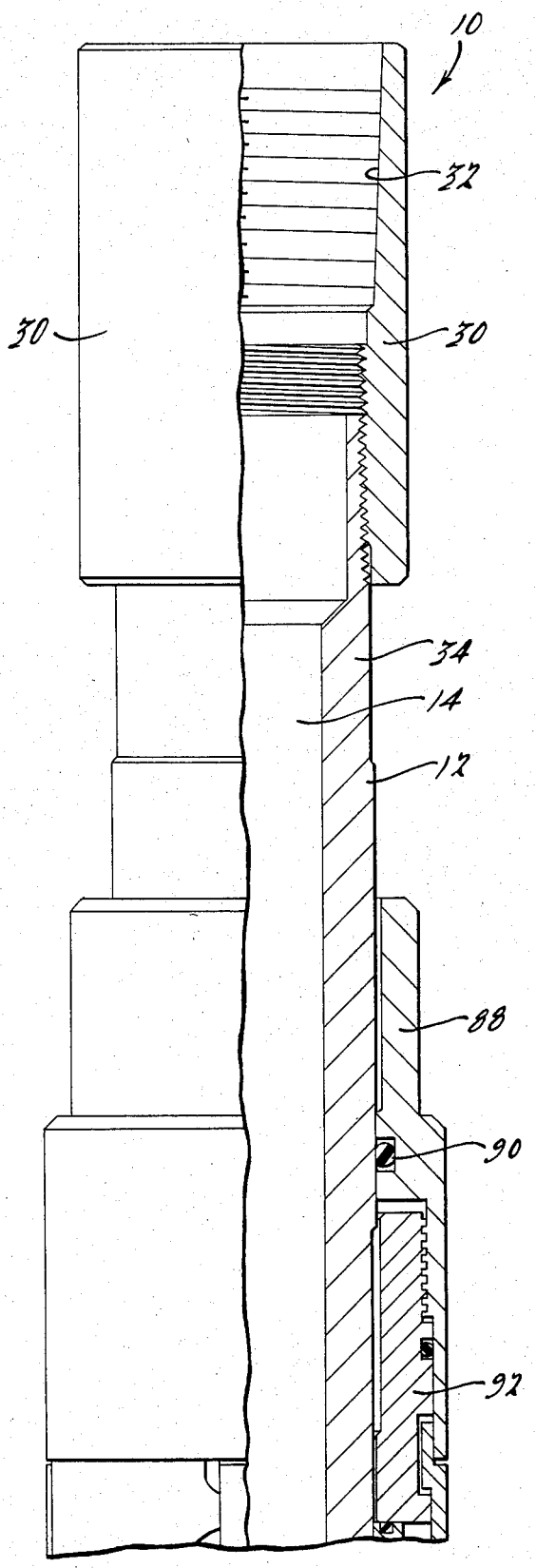
FIGS. 1*a* through 1*f* are side elevational, partially segmented views of the sealing packer in accordance with the invention.

In general, referring to FIGS. 1*a* through 1*f*, the sealing packer 10 includes an inner sleeve assembly 12 that has a central passage 14 passing therethrough. An upper outer sleeve assembly 16 includes a hold down mechanism 18. In addition, the upper outer sleeve assembly 16 includes a plurality of upper packing elements 20*a*, 20*b* and 20*c*. A lower outer sleeve assembly 22 is coaxially mounted about the inner sleeve assembly 12 and also includes a plurality of lower packing elements 24*a*, 24*b* and 24*c* and a setting mechanism 26.

Figure 1B:
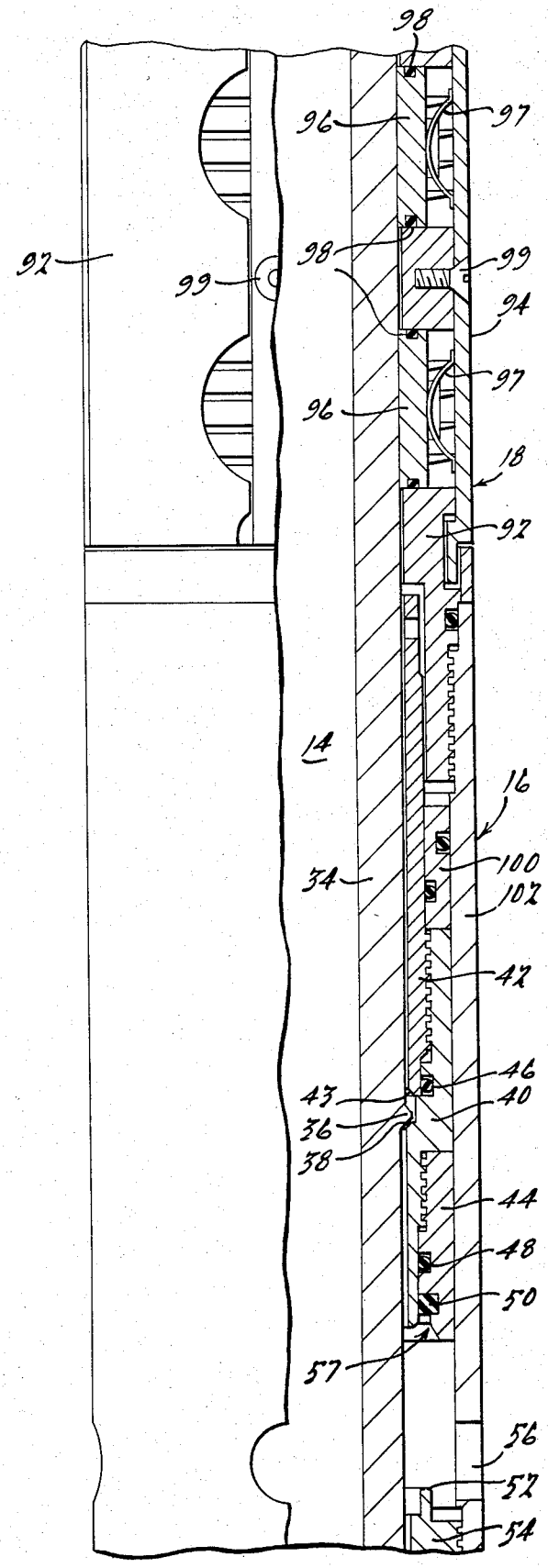
Figure 2A:
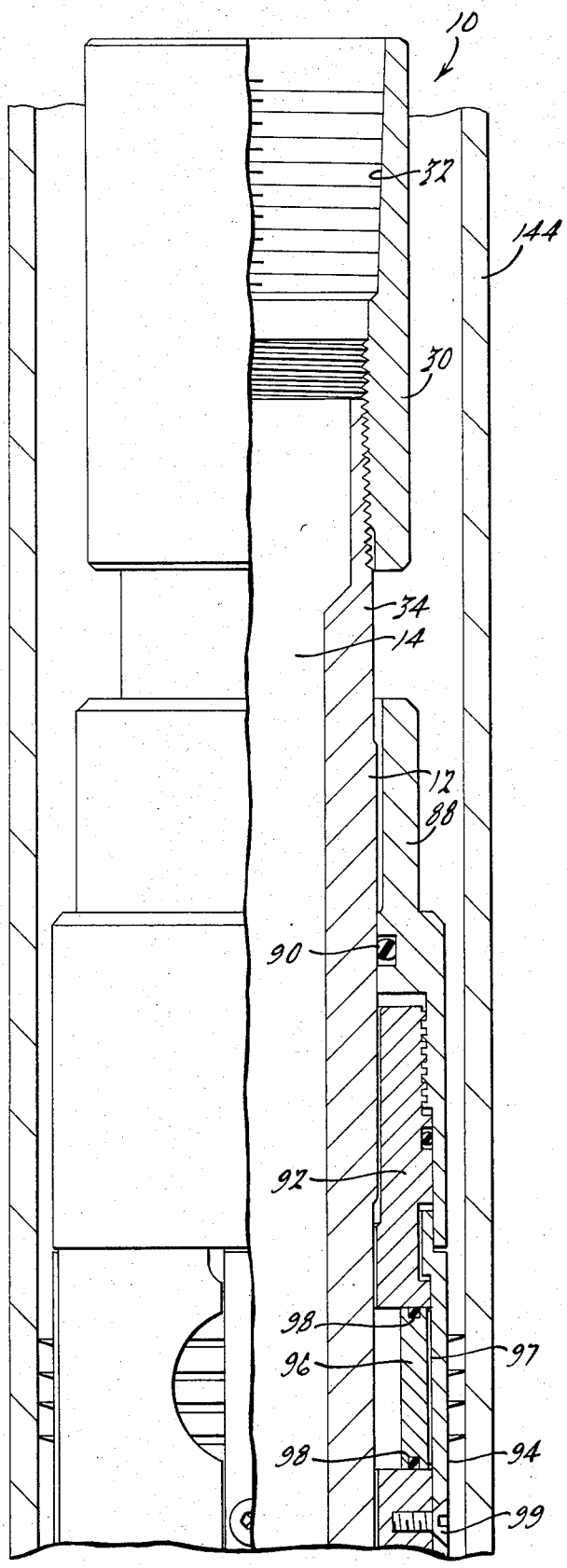
FIGS. 2*a* through 2*f* are side elevational, partially segmented views of the sealing packer in a set position in the well casing.
Figure 2B:
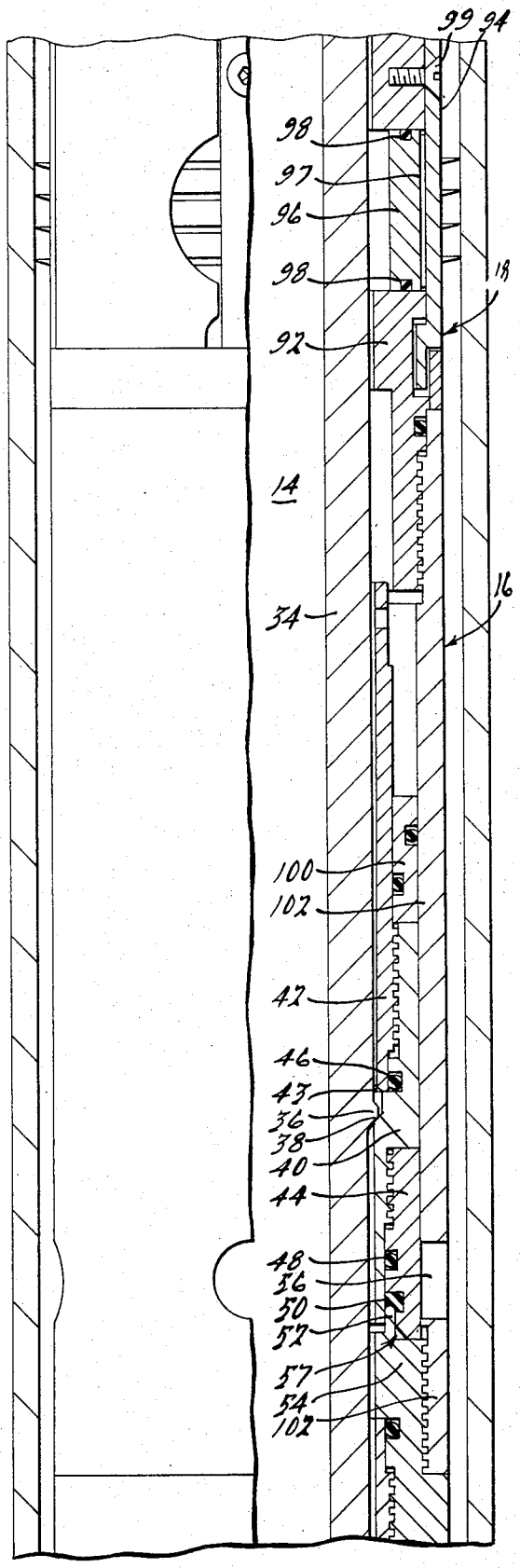
Figure 2C:
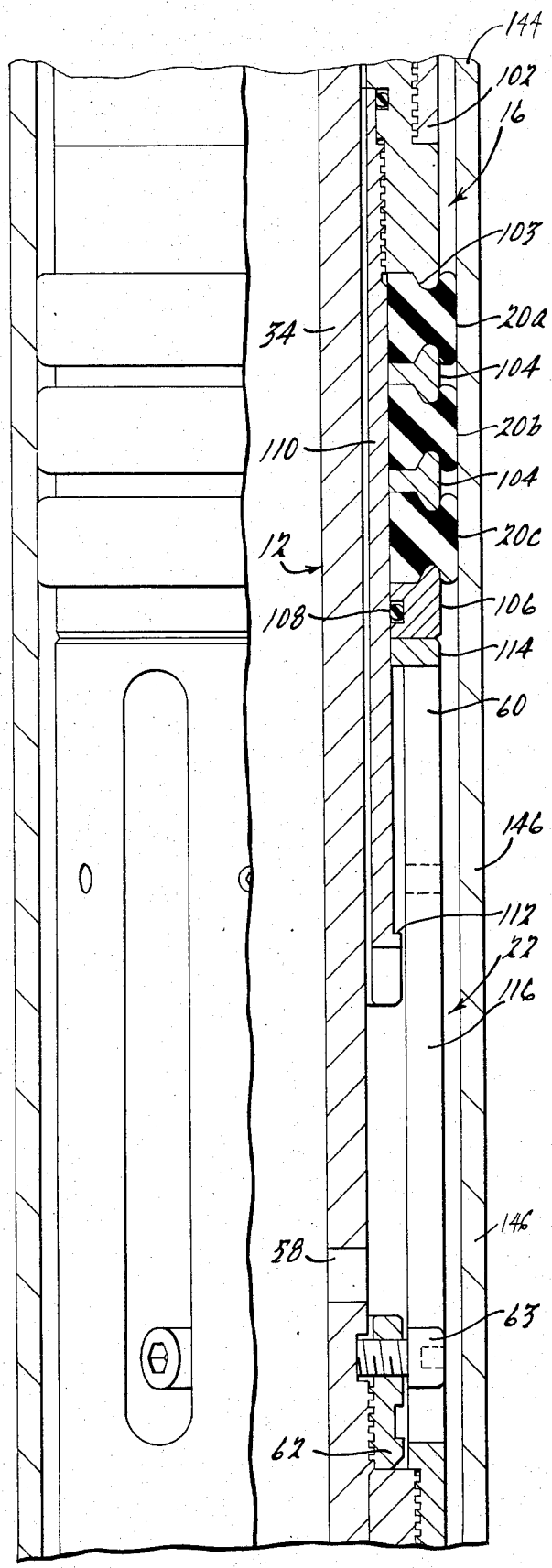

In more detail, particularly as shown in FIG. 1*a*, the inner sleeve assembly 12 includes a top coupling member 30 which has threads 32 to be coupled to a work string (not shown). The coupling member 30 is attached to an inner mandrel 34. As shown in FIG. 1*b* the inner mandrel has an annular flange 36 which is abutable against an upwardly facing seat 38 of a seal receptacle member 40. The seal receptacle member 40 is fixed to a compensating mandrel 42 that has a downwardly facing seat 43. An O-ring 46 is interposed between the members 40 and 42. The seal receptacle member 40 is also fixed to a seal retainer member 44. O-ring 48 is interposed therebetween. A valve seal 50 is seated between the members 40 and 44 and is sealingly abutable against an annular flange 52 of the unloading valve body 54 to form a top unloading valve 57. Downward movement of the members 40, 44 and seal 50 provides a seal between members 50 and 52 and closes off the central passage 14 of the mandrel from fluid communication to an aperture 56 in upper outer sleeve assembly 16. In other words unloading valve 57 becomes closed as shown in FIG. 2*b*.

Figure 1C:
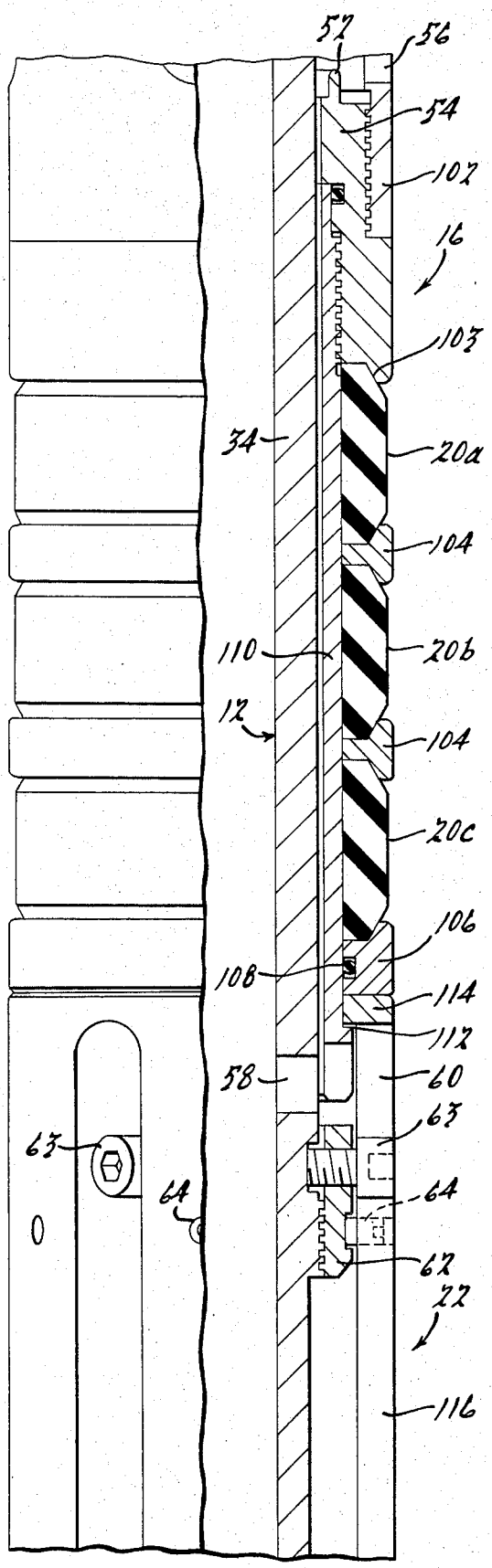

Referring now to FIG. 1*c*, the inner mandrel 34 extends downwardly and has a side port 58 extending therethrough in line with slots 60 in lower outer sleeve assembly 22. A mandrel cap 62 is threadably connected to the inner mandrel 34. Cap screws 63 are positioned in slots 60 and extend through the cap 62 and engage the inner mandrel 34. Furthermore, sheer screws 64 extend through lower outer sleeve assembly 22 and releasably retain the mandrel cap 62 and thus the inner sleeve assembly 12 in place. When release is desired, force over predetermined amount sheers the screws 64 and thus releases the inner sleeve assembly 22 with respect to the upper outer sleeve assembly 16.

Figure 1D:
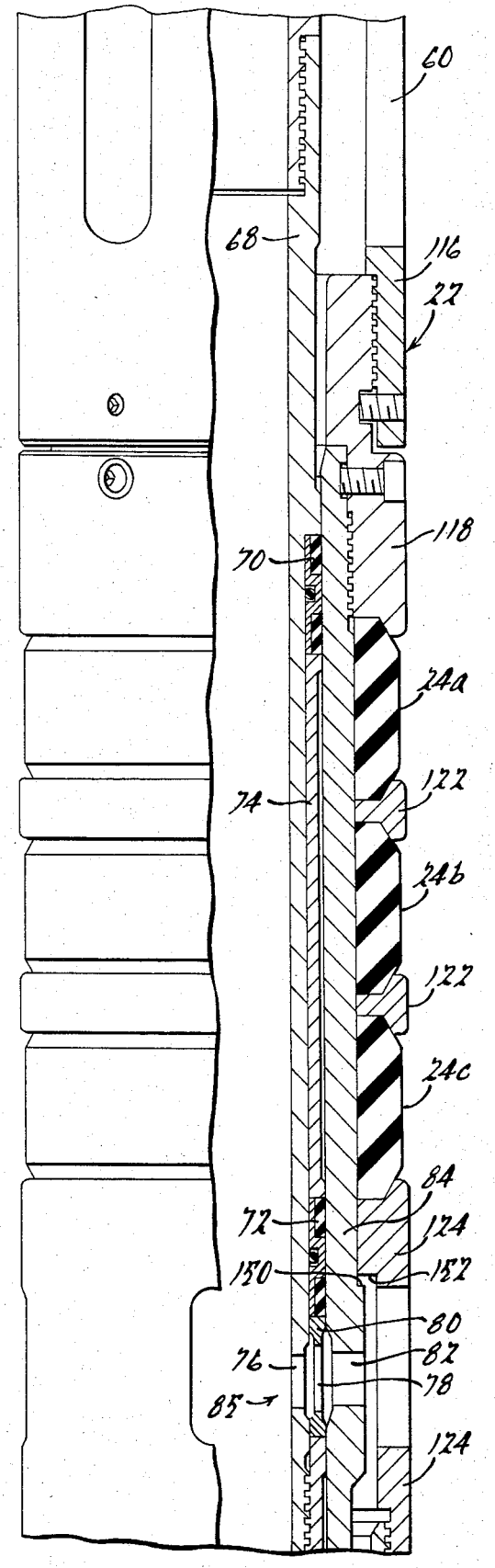
Figure 1E:
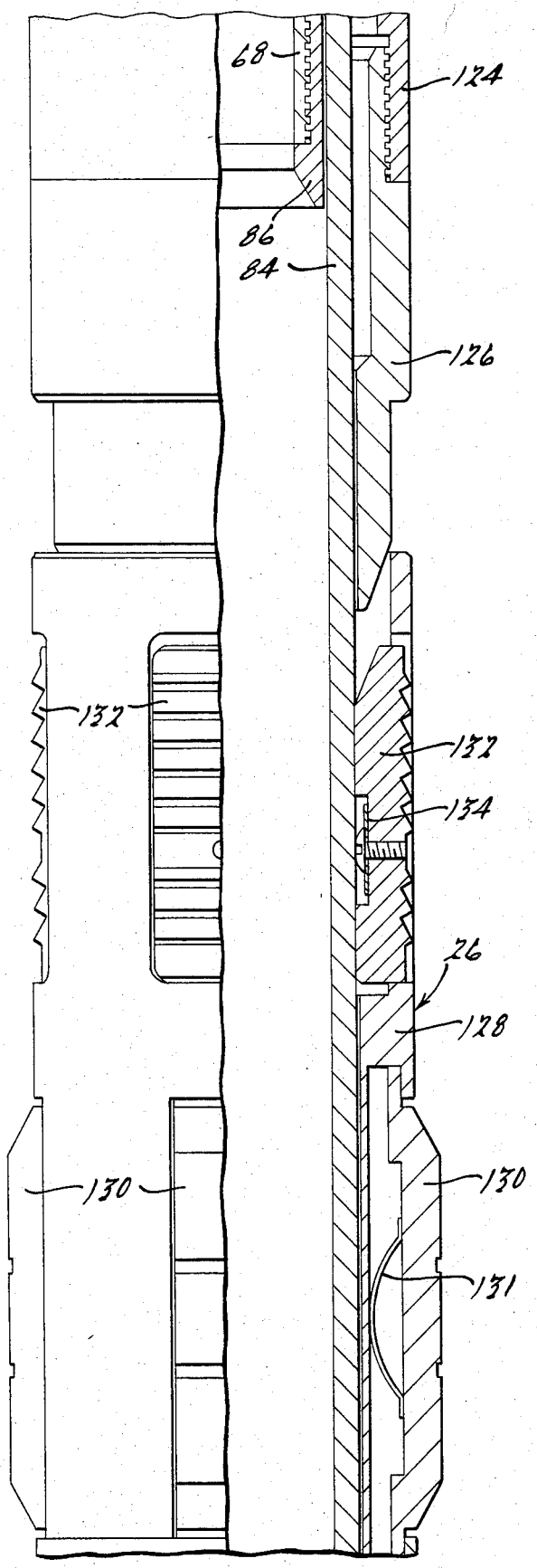

The inner mandrel 34 extends downwardly and is connected at its lower end to a seal mandrel 68 as shown in FIG. 1*d*. The seal mandrel 68 seats two seal assemblies 70 and 72 spaced by a seal spacer 74. The mandrel member 34 has a side port 76 therethrough which is alignable with an aperture 78 in a lower seal spacer member 80 and an aperture 82 within a lower mandrel member 84 in the lower outer sleeve assembly 22 to form a lower unloading valve 85. The seal mandrel 68 has its lower end connected to the seal mandrel cap 86 as shown in FIG. 1*e*.

Referring back to FIGS. 1*a* and 1*b*, the hold down mechanism 18 of the upper outer sleeve assembly 16 includes a hold down cap 88 that seats an O-ring 90 that abuts the mandrel member 34. The cap 88 is fixed to a hold down member 92. The hold down member 92 houses hold down buttons 96 that are retained therein by hold down straps 94 screwed thereon by screws 99. Hold down buttons 96 are spring loaded by springs 97 toward the axial center and have O-ring seals 98 to provide a piston-type function due to pressure differential between the exterior side and the interior side of the hold down buttons 96. Below the hold down member 92 is a balancing piston 100 which hold down the valve members 40 and 44 as well as the compensating mandrel and inner mandrel 34 via annular shoulder 36 and lower facing shoulder 43 on the compensating mandrel 42.

The hold down member 92 is secured to a central body member 102 which has aperture 56 extending therethrough. The central body member 102 is connected to unloading valve body 54 which has its lower end forming a seat 103 for the uppermost packing element 20 as shown in FIG. 1*c*. Spacers 104 are interposed between the first and second upper packing elements 20*a* and 20*b* and second and third upper packing elements 20*b* and 20*c*. The lowermost packing element 20*c* abuts a piston 106 that seats an O-ring 108 sealingly and slidably engaged to a seating mandrel 110. Seating mandrel 110 has a shoulder 112 which interlocks with an abutment end 114 of a slotted sleeve member 116 of lower outer sleeve assembly 22. The slotted sleeve member 116 receives the sheer screws 64.

Referring back to FIG. 1*d*, the lower sleeve assembly 22 has its slotted sleeve 116 connected to a seating member 118 which has its lower end seated against the uppermost lower packing element 24*a*. The packing elements 24*a*, 24*b* and 24*c* are seated about lower mandrel 84 and also has two spacer elements 122 interposed between the first and second lower packing elements 24*a* and 24*b* and second and third packing elements 24*b* and 24*c*. The lowermost packing element 24*c* is seated against a retainer member 124 of the setting mechanism 26. The retaining member 124 is connected to setting cone 126 shown in FIG. 1*e*. Setting mechanism 26 also includes a drag block assembly 128 that includes a drag block 130 spring loaded by spring 131 toward an extended position. Setting slips 132 are enclosed or housed in assembly 128 and are spring biased by springs 134 to the retracted position.

Figure 1F:
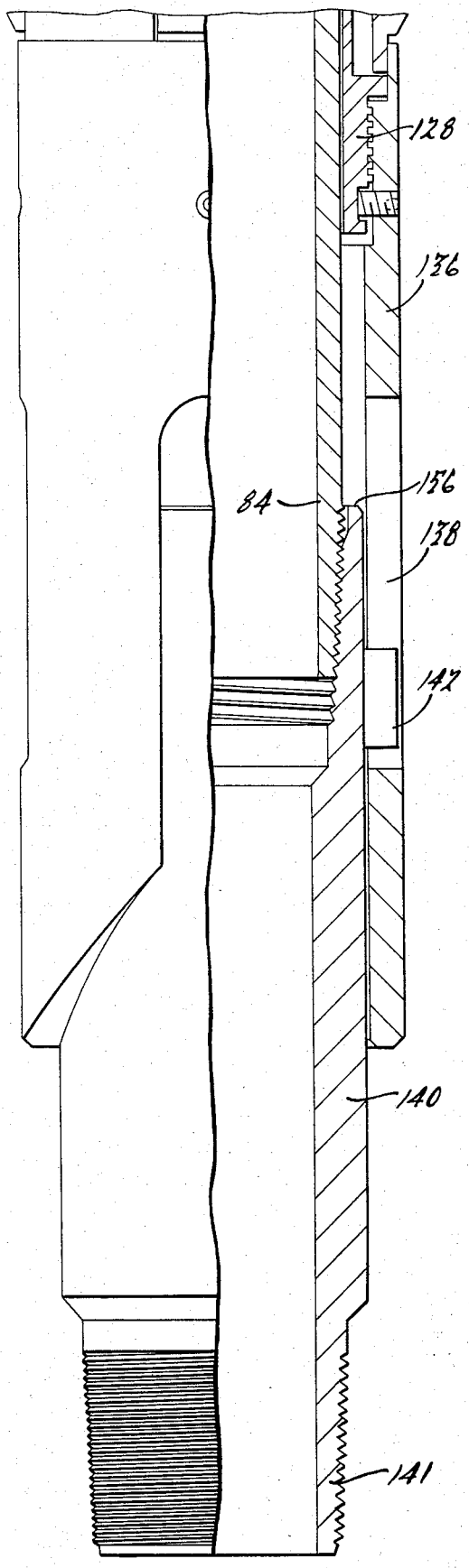

Referring to FIG. 1*f*, the drag block assembly 128 is secured to a J-body 136 with a slot 138. Lower mandrel 84 has its lower end secured to the bottom subassembly 140 that has a lug 142 that is received within the slot 138 of the J-body to secure the setting mechanism in the non-actuated position.

Figure 2D:
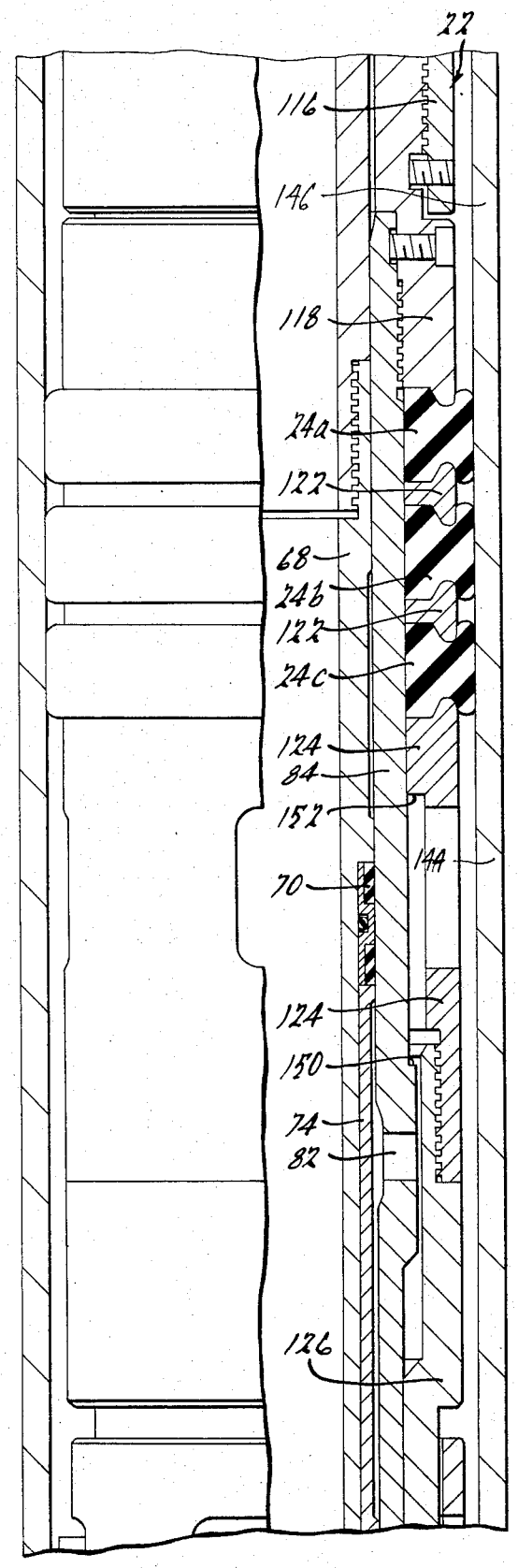
Figure 2E:
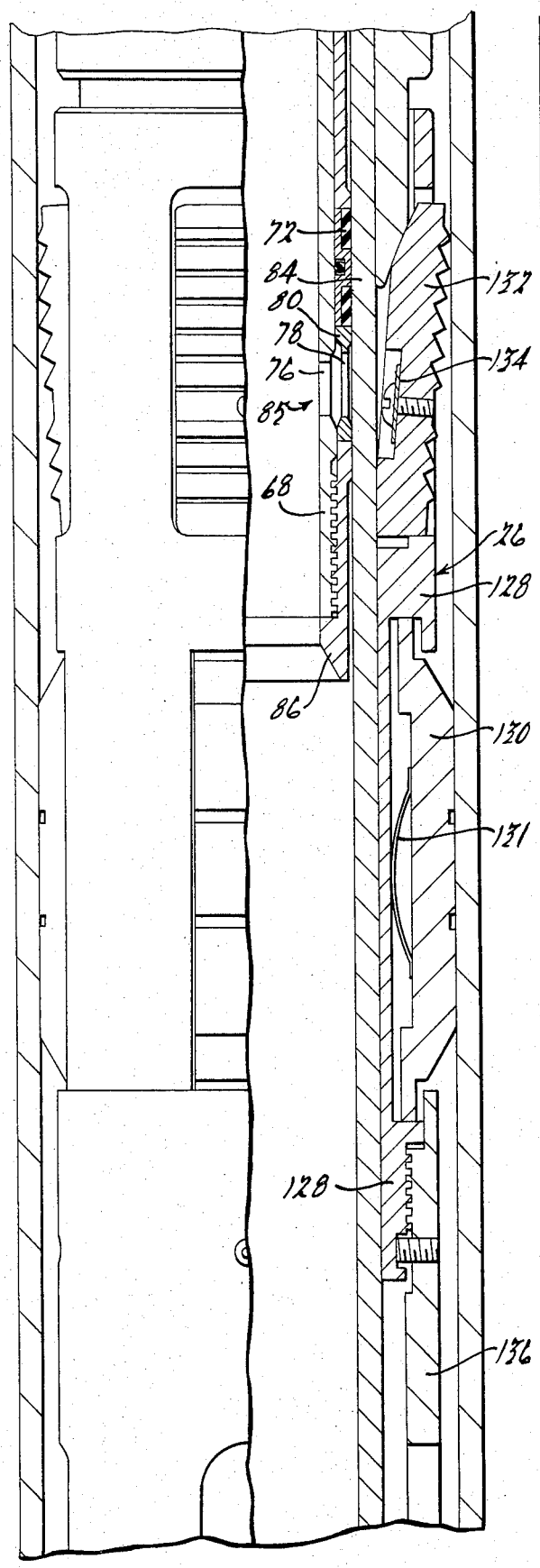
Figure 2F:
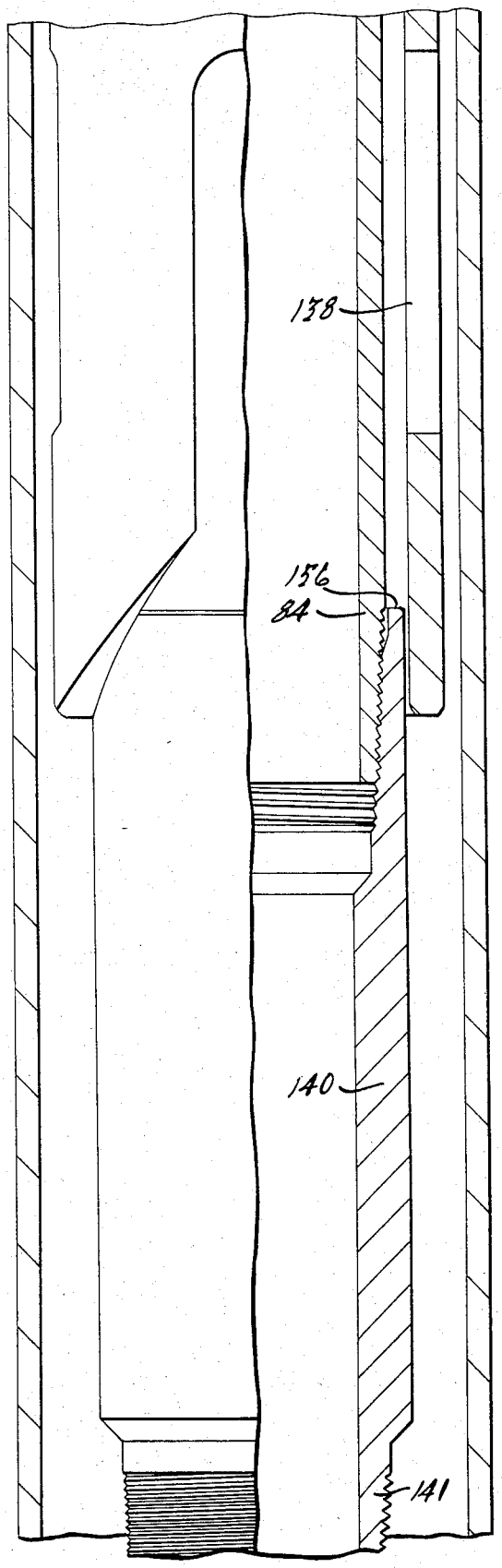

Operation and setting of the packer 10 can now be discussed with reference to FIGS. 2*a* through 2*f*. The packer can be extended down within a well casing 144 to the desired depth. When the desired depth is reached, the work string can be rotated which in turn rotates inner sleeve assembly 12. An inner sleeve assembly 12 rotates cap screws 63 in slots 60 forcing the lower outer sleeve assembly 22 to rotate such that lug 142 rotates in slot 138 to a position where it can freely move downwardly out through J-body 136 as shown in FIG. 2*f*.

The work string can then be extended downwardly. Downward movement of the inner mandrel 34 closes off the upper unloading valve 57 and shuts off communication through aperture 56 and forces seal 50 onto annular flange 52. Furthermore, downward movement of the inner sleeve assembly 12 as shown in FIGS. 2*d* and 2*e* slides the sealed mandrel 68 downwardly to misalign apertures 76 and 78 from aperture 82 and to span aperture 82 with seal assembly 72 to close lower unloading valve 85.

Continued downward movement of the work string exerts a downward force on the unloading valve body 54 which exerts a downward force on the packing elements 20 and abutment 114 of the slotted sleeve 116 which in turn exerts a downward force on the lower outer sleeve assembly 22. This movement continues until the cone element 126 comes into contact with slips 132. Downward movement of the drag block assembly 128 provided by drag block 130 is retarded to cause the cone 126 to abut slips 132. As the slips 132 are set, the setting mechanism 26 fixes itself and lower seat member 124 in well casing 144. Thus, any further movement of the work string moves the upper outer sleeve assembly 16 and seating member 118 toward the retainer member 124 to axially compress the packing elements 20*a*, *b* and *c* and lower packing elements 24*a*, *b* and *c* to deform them outwardly and form a seal against the well casing 144.

After the packing elements 20 and 24 are deformed, acidizing of the well casing 144 at a section 146 located between the upper packing elements 20 and lower packing elements 24 can occur if an optional plug (not shown) is attached to the lower end 141 of the lower subassembly 140. If the plug is not there, the entire zone below the upper packing elements 20 can be acidized.

Either way, as fluid is pumped through the central passage 14 through the work string and through the inner sleeve 34, the fluid can pass through side ports 58 and through the slots 60 to acidize the section 146. If the plug seals off the lower sub 140, fluid is prevented from entering into the well casing below lower packing elements 24 because the seal elements 70 and 72 of lower unloading valve 85 sealingly shut off aperture 82. Furthermore, the area above upper packer elements 20 is prevented from being acidized via the closing of unloading valve 57 sealing off aperture 56.

Upward fluid pressure exerted on the lower end in cross section of seal mandrel cap 86 is compensated by the downward force of the same fluid pressure exerted on balancing piston 100. The fluid is free to flow up through the retaining compensating mandrel 42 to the upper side of the balancing piston 100. Downward force on the piston 100 exerts a downward force on the member 40 which in turn exerts a downward force on unloading valve body 54 on the upper outer sleeve assembly 16. The retaining shoulder 43 transfers this downward force onto the annular flange 36 of the inner mandrel 34 to balance the upward force exerted on lower mandrel cap 86.

As fluid pressure is exerted down through the work string, hold down buttons 96 are radially actuated outwardly and act as slips to prevent any upward movement relative to the well casing.

As the pressure builds and further sealing strength is needed for packing elements 20 and 24, pressure is exerted on the underside of piston 106 which forces the piston upwardly to further deform the upper packer elements 20 against the well casing 144. The abutment member 114 is independent of piston 106 and moves downwardly via pressure exerted on the sleeve 116 to further compress lower packing elements 24. In this fashion, as the pressure increases and a higher sealing power is needed, the piston 106 and abutment member 114 provide for this additional sealing capacity by separating and further deforming packing elements 20 and 24, respectively.

When acidizing is completed and the retrieval of the packer 10 is desired, the pressure within passage 14 is relieved to release the hold down mechanism 18 and piston 106. The work string is merely raised which opens up aperture 56 on the upper unloading valve 57 and realigns apertures 76, 78 and 82 to open the lower unloading valve 85. In this way fluid above the packing elements can enter through the unloading valve 57 to the central passage 14, bypass the upper packing elements 20 and lower packing elements 22, and then exit through the lower unloading valve 85 if a plug seals lower end 141. The setting mechanism is released via shoulders 150 abutting shoulders 152 on member 124. Lifting releases or relaxes the packing elements 20 and 24. Furthermore, the upper end 156 of the lower sub 140 abuts the drag block assembly 128 to retrieve the setting mechanism.

In this fashion, a particular section of well casing or an entire lower zone of well casing can be acidized with a packer safely and easily retrieved after the acidizing is completed.

Variations and modifications of the present invention are possible without departing from its spirit and scope as defined by the appended claims.

The embodiments in which an exclusive property or privilege is claimed are defined as follows:

1. A sealing packer for a wall casing characterized by:

a tubular inner sleeve with a passage therethrough;

an upper outer sleeve assembly mounted about said inner sleeve and including:

a resiliently deformable upper packing element;

seat means for seating said upper packing element;

hold down means for engaging a well casing and retaining said outer sleeve assembly stationary against upwardly directed well pressures;

a lower outer sleeve assembly slidably mounted about said inner sleeve and including:

a resiliently deformable lower packing element;

first seat means for seating said lower packing element;

abutment means for compressing said upper packing element between said abutment means and said seat of said upper outer sleeve assembly;

said upper packing element constructed such that when compressed it engages said well casing, setting means for fixing a second seat means of said lower outer sleeve assembly relative to said well casing:

said lower packing element being deformable between said first and second seat means of said lower outer sleeve assembly to engage said well casing;

piston means normally adjacent said abutment means and separable therefrom, said piston means responsive to fluid pressure in said passage and in said well casing between said lower and upper packing elements when said packing elements deformably engage said well casing to separate from said abutment means and further deform said upper packing element; and said tubular inner sleeve having a port for allowing fluid communication from said passage to a section of said well casing interposed between said upper and lower packing elements.

2. A sealing packer as defined in claim 1 wherein a lower unloading valve compreses apertures passing through said inner sleeve and said lower outer sleeve assembly selectively aligned to open said unloading valve when the inner sleeve is upwardly moved with respect to said outer sleeve assemblies and misaligned to close said unloading valve by downward movement of said inner sleeve; said apertures in fluid communication with a top unloading valve through said upper outer sleeve assembly to let fluid flow through said inner sleeve bypassing said packer elements when said sealing packer is retrieved upwardly.

3. A sealing packer for a well casing characterized by:

a tubular inner sleeve with a passage therethrough;

an upper outer sleeve assembly mounted about said inner sleeve and including:

a resiliently deformable packing element;

seat means for seating said upper packing element;

hold down means for engaging a well casing and retaining said outer sleeve assembly stationary against upwardly directed well pressures;

a lower outer sleeve assembly slidably mounted about said inner sleeve and including:

a resiliently deformable lower packing element;

first seat means for seating said lower packing element;

abutment means for deforming said upper packing element between said abutment means and said seat of said upper outer sleeve assembly;

said upper packing element constructed such that when deformed it engages said well casing;

setting means for fixing a second seat means of said lower outer sleeve assembly relative to said well casing;

said lower packing element being deformable between said first and second seat means of said lower outer sleeve assembly to engage said well casing;

said tubular inner sleeve having a port for allowing fluid communication from said passage to said well casing interposed between said upper and lower packing elements;

port means through said inner sleeve and said lower outer sleeve assembly being selectively closed to seal fluid communication from the well casing below said lower packing element to the well casing above said lower packing element and opened to allow fluid communication therebetween; and piston means adjacent said upper packing element and being responsive to fluid pressure in said passage and in said well casing between said lower and upper packing elements when said packing elements deformably engage said well casing to press against said upper packing element and further deform said packing element to create a stronger seal against said well casing.

4. A sealing packer for downhole placement within a well casing, said packer comprising:

a tubular inner sleeve with a central passage therethrough;

an upper outer sleeve assembly mounted about said inner sleeve and including a resiliently deformable upper packing element and hold down means responsive to fluid pressure within said central passage for engaging the well casing and retaining said outer sleeve assembly stationary against upwardly directed well fluid pressures;

a lower outer sleeve assembly slidably mounted about said inner sleeve and including a resiliently deformable lower packing element and setting means for initially setting said sealing packer relative to said well casing;

port means from said central passage and to a section of said well casing between said upper and lower packing elements; and piston means disposed between said packing elements and responsive to fluid pressure in said central passage and said well casing section when said packing elements deformably engage said well casing to further deform said upper packing element.

5. The sealing packer as defined in claim 4 and further comprising balancing piston means responsive to fluid pressure in said central passage for hydrostatically balancing said inner sleeve against upwardly directed well fluid pressures.

* * * * *

UNITED STATES PATENT AND TRADEMARK OFFICE

CERTIFICATE OF CORRECTION

PATENT NO. : 4,640,351

DATED : February 3, 1987

INVENTOR(S) : Ted G. Clifton and Robert L. Brookey

It is certified that error appears in the above—identified patent and that said Letters Patent is hereby corrected as shown below:

IN THE CLAIMS:

Claim 1, line 1, delete "wall" and insert --well--.
Claim 2, line 2, delete "compreses" and insert --comprises--.

IN THE ABSTRACT

Line 11, delete "the" (first occurrence) and insert --to--.

Signed and Sealed this

Twentieth Day of September, 1988

*Attest:*

DONALD J. QUIGG

*Attesting Officer*

*Commissioner of Patents and Trademarks*